US006474052B2

(12) United States Patent
Kempsell et al.

(10) Patent No.: US 6,474,052 B2
(45) Date of Patent: Nov. 5, 2002

(54) "WESTERN" STYLE SADDLES

(76) Inventors: David Kempsell, Little Duskin Farm, Covet Lane, Kingston, Cantebury, Kent (GB); Margaret Lesley White, Little Duskin Farm, Covet Lane, Kingston, Canterbury, Kent (GB)

( * ) Notice: Subject to any disclaimer, the term of this patent is extended or adjusted under 35 U.S.C. 154(b) by 0 days.

(21) Appl. No.: 09/728,480

(22) Filed: Dec. 4, 2000

(65) Prior Publication Data

US 2001/0005980 A1 Jul. 5, 2001

(30) Foreign Application Priority Data

Dec. 2, 1999 (GB) ..... 9928380

(51) Int. Cl.[7] ..... B68C 1/08
(52) U.S. Cl. ..... 54/44.6; 54/44.5
(58) Field of Search ..... 54/44.1, 44.5, 54/44.6

(56) References Cited

U.S. PATENT DOCUMENTS

| | | | | | |
|---|---|---|---|---|---|
| 734,100 | A | * | 7/1903 | Sena | 54/44.5 |
| 753,751 | A | * | 3/1904 | Stern | 54/44.6 |
| 3,343,338 | A | * | 9/1967 | Stubben | 54/44.6 |
| 5,191,752 | A | * | 3/1993 | Murphy | 54/44.5 |
| 5,555,710 | A | * | 9/1996 | Smith | 54/44.6 |
| 5,740,665 | A | * | 4/1998 | Belton | 54/44.1 |
| 6,050,067 | A | * | 4/2000 | Knight et al. | 54/44.6 |

FOREIGN PATENT DOCUMENTS

| | | | | |
|---|---|---|---|---|
| FR | 2632623 A | * | 12/1989 | 54/44.6 |

* cited by examiner

*Primary Examiner*—Charles T. Jordan
*Assistant Examiner*—Elizabeth Shaw
(74) *Attorney, Agent, or Firm*—Connolly Bove Lodge & Hutz LLP

(57) ABSTRACT

The present invention describes improvements in "Western" style saddles allowing existing saddles to be converted to a European saddle panel style which will facilitate a method of modelling the underside of the saddle to fit a horse's back. There is described a panel adapted for mounting to an underside of a skirt of a saddle, the panel comprising a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium. The resilient medium may be conventional flocking, but preferably comprises at least one inflatable bladder. The use of two generally coplanar inflatable bladders arranged to provide an overlap between the two bladders, is preferred.

18 Claims, 7 Drawing Sheets

"WESTERN" STYLE SADDLES

BACKGROUND OF THE INVENTION

1. Field of the Invention

The present invention relates to improvements in "Western" style saddles by allowing existing saddles to be converted to a European saddle panel style which will facilitate a method of modelling the underside of the saddle to fit a horse's back by the traditional method of flocking with wool or substitute or by utilisation of disclosures made in Patent EP 0 764 607 A1 for the protection of the horse's back.

Herein "tree" is a term use to describe the solid structure that once the webbing, foams, leather, etc are affixed, becomes the "seat" for the rider.

Herein "Western" is a generic term for a type of saddle construction, which does not incorporate a "flocked panel" and that requires the use of saddlecloths or blankets to form a pad for protecting the horse's back from the saddle's tree, and is intended to include saddles of the "Spanish" & "Portuguese" Type.

Herein "European saddle" is the term used to describe those saddles that have "flocked panels", which are affixed to the seat and that allow for adjustment of their shape.

Herein a "flocked panel" is a closed pocket, which is filled with material, normally natural or synthetic wool, foam or felt. This flocked panel forms the cushion or bearing surface between the horses back and the saddle's tree. Because a flocked panel can be shaped by stuffing it with the flocking material to alter its' contour it can be fitted to the horse's shape.

2. Description of the Prior Art

Western saddles have a substantial tree made of wood, plastic or tightly bundled straw stitched into a fabric. Some may have metal reinforcement. The tree's purpose is to form the foundations for the rider's seat and a medium to spread the rider's weight over the horse's back. Typically the construction is two shaped bars that sit either side of the backbone of the horse. Arches connect these bars laterally together. The front arch forms the pommel or front of the seat the rear arch forms the cantle or back of the seat.

Skirts normally cover the bars of the tree. These skirts are usually made up of ornate leatherwork on their upper side and sheepskin or a synthetic equivalent on the horse's side. The skirts are normally bigger than the bars extending over the shoulder in front and sometimes over the 18th rib of the horse and on to the lumber region at the back of the saddle. This is bad practice as the horse's muscular and skeletal movements of the back are greatest at the shoulder and lumber regions. Pressure on these points very quickly causes restricted movement and/or excessive irritation by rubbing.

Because there is no padding of any substance between the horse's back and the hard bars of the saddle it is essential that additional saddlecloths be used to pad the saddle. Saddlecloths are traditionally like blankets but with the advent of new foam materials some pads are all foam or foam based.

Saddlecloths have several significant disadvantages including:

1. Saddlecloths are not an integral part of the saddle construction so they can move under the saddle where they can crease up and cause major discomfort to the horse;
2. The saddlecloth has to bridge the horse's spinal processes therefore placing direct pressure on those processes. This is not only uncomfortable for the horse but potentially very damaging;
3. Saddlecloths hold sweat and build up heat, the two thing that contribute to soreness and irritation;
4. The more saddlecloths used the further the saddle is from the horse's back, this causes instability in the saddle; and
5. They decrease the sensitivity of the horse to the back and seat aides of the rider. The rider uses his weight and balance in the saddle to command the horse and these commands become unclear in an ill-fitting saddle.

Turning to the European saddle panel, it was designed to give a means of shaping the saddle to each individual horse to obtain a good fit whilst also not requiring the use of a saddlecloth. The European saddle has two panels on either side of the spine that fit between a point snug behind the scapula of the horse and the 18th vertebrae, and never extends further back than this point. It also has a gullet between the two panels typically about 2½ inches in width so that no pressure is applied to the spinal processes. In this way pressure is only placed on the horses back on those structures of the back capable of taking the pressure whilst not interfering with the most mobile and/or sensitive structures of the horse's back.

Another advantage of the European method of fitting saddles is that the balance of the saddle front to back can be altered so that the rider is neither tilted forward or backward whilst in the saddle. This is achieved by the distribution of the flocking. However, in prior art EP 0 764 607 A1, this is achieved with air bags being inflated to differing levels. It has been proved that ¼ inch up or down from the perfectly balanced rider, as measured by the height of the cantle from the horse's back, will make that rider feel tipped forward or back.

Balance in a Western saddle is achieved by shimming i.e. saddlecloths that are placed under the saddle perhaps folded in half or by wedge shaped foam pieces. This practice is not accurate, sustainable or repeatable to any degree of reliability as the saddlecloths have a tendency to move.

The European saddle is adjusted by pushing flocking (usually wool or a synthetic material) into the pockets or panels on either side of the underside of the seat of the saddle, a job requiring the skills of the saddler. These panels, starting at the back of the saddle, run its length along the backbone and then turn downwards following the knee rolls of the saddle over the horse's shoulders. The wadding is forced through holes in the upper surface of each panel hidden under the saddle's seat, thereby forming a cushion for the saddle against the horses back.

There is however a disadvantage with the European method of saddle fitting in that the saddler needs to be very careful in ensuring consistent density of wadding in the panels to avoid uneven or hard areas, which would give rise to discomfort for the horse. Also, over the course of time, with riding, the wadding is prone to move and can become hard through compression and the absorption of the horse's sweat. A saddle padded in this way will require re-flocking of the panels by the saddler. Alternatively, the use of the air bladder system as disclosed in prior art EP 0 764 607 A1 overcomes this disadvantage.

It is the aim of the present invention to provide a simple means of adapting Western saddles to a European method of fitting to the horse by the additional flocked panel herein known as a "conversion panel". This conversion panel can be fixed to any western saddle therefore becoming part of it construction. This will give the saddler a means of shaping the conversion panel to fit the horse's back profile whilst not changing the appearance of the saddle to the onlooker. Western saddles in general are more ornate than European saddles having a visual impact so it is vital not to detract from their appeal by modifying them from their traditional appearance.

BRIEF DESCRIPTION OF THE INVENTION

In its broadest sense, the present invention provides allows for the modification of a Western Saddle to a European panel design by the use of two additional closed pockets affixable to the saddles tree via Velcro and/or screw fittings. This will allow the underside of the saddle to be molded by the traditional flocking methods to conform and fit the horse's back profile assuring better stability for the rider and comfort for the horse. The present invention will also allow the use of air bladder system as disclosed in prior art EP 0 764 607 A1.

In one aspect, the present invention provides a method of modifying a saddle having first and second skirts, the method comprising securing a panel to an undersurface of each skirt; wherein each panel comprises a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium.

In a second aspect, the present invention provides a saddle having first and second skirts, each skirt having affixed to an underside thereof a respective panel; wherein each panel comprises a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium.

In a third aspect, the present invention provides a panel adapted for mounting to an underside of a skirt of a saddle, the panel comprising a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium.

The resilient medium may comprise wool. Preferably, the resilient medium comprises at least one inflatable bladder. More preferably, it comprises two generally coplanar inflatable bladders arranged to provide an overlap between the two bladders.

Preferably, the padded material is natural or synthetic sheepskin or a foamed synthetic material.

Suitably, the flexationally resistive material is stiff leather.

BRIEF DESCRIPTION OF THE VARIOUS VIEWS OF THE DRAWINGS

The above and other aspects of the present invention will now be illustrated in further detail, by way of example only, with reference to the accompanying figures in which.

Figure 3:
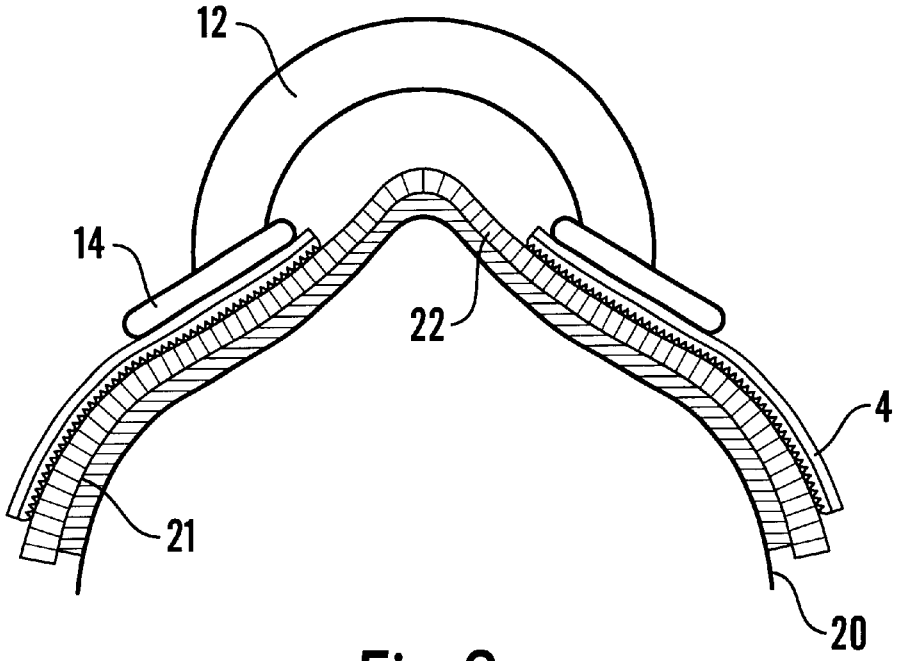
Figure 4:
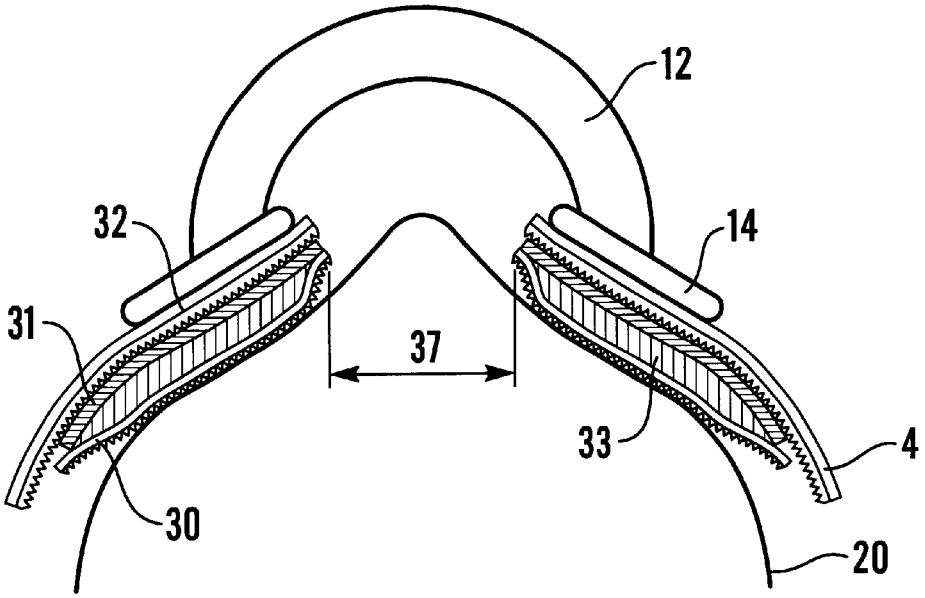
Figure 5:
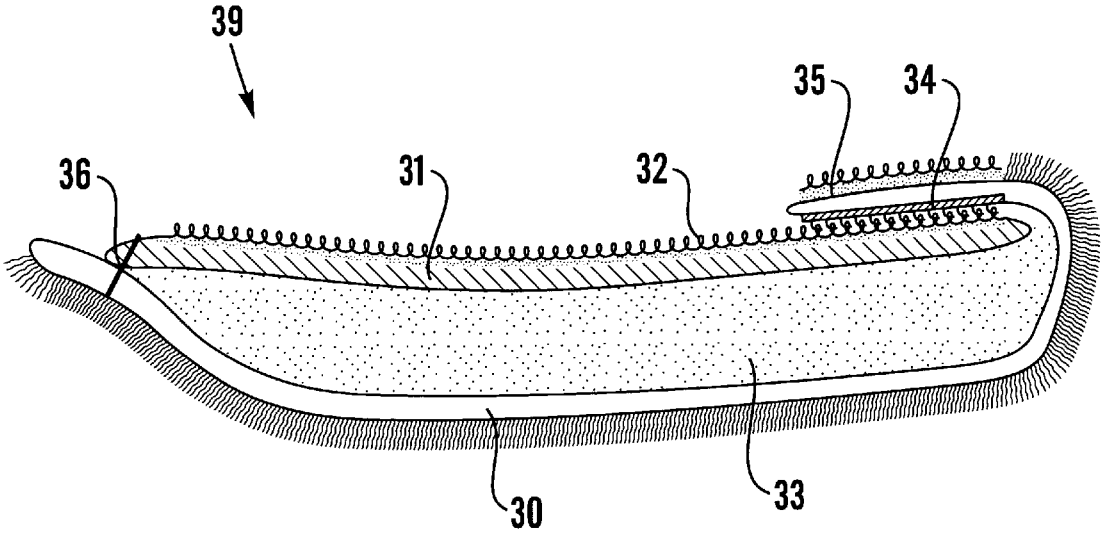
Figure 6:
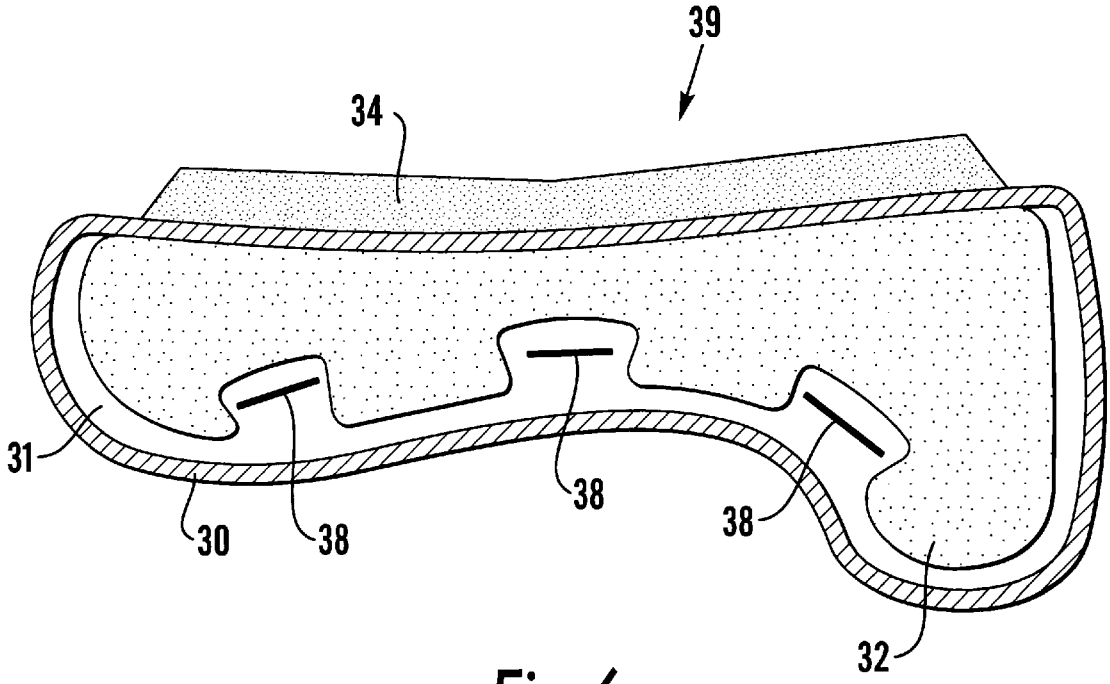
Figure 7:
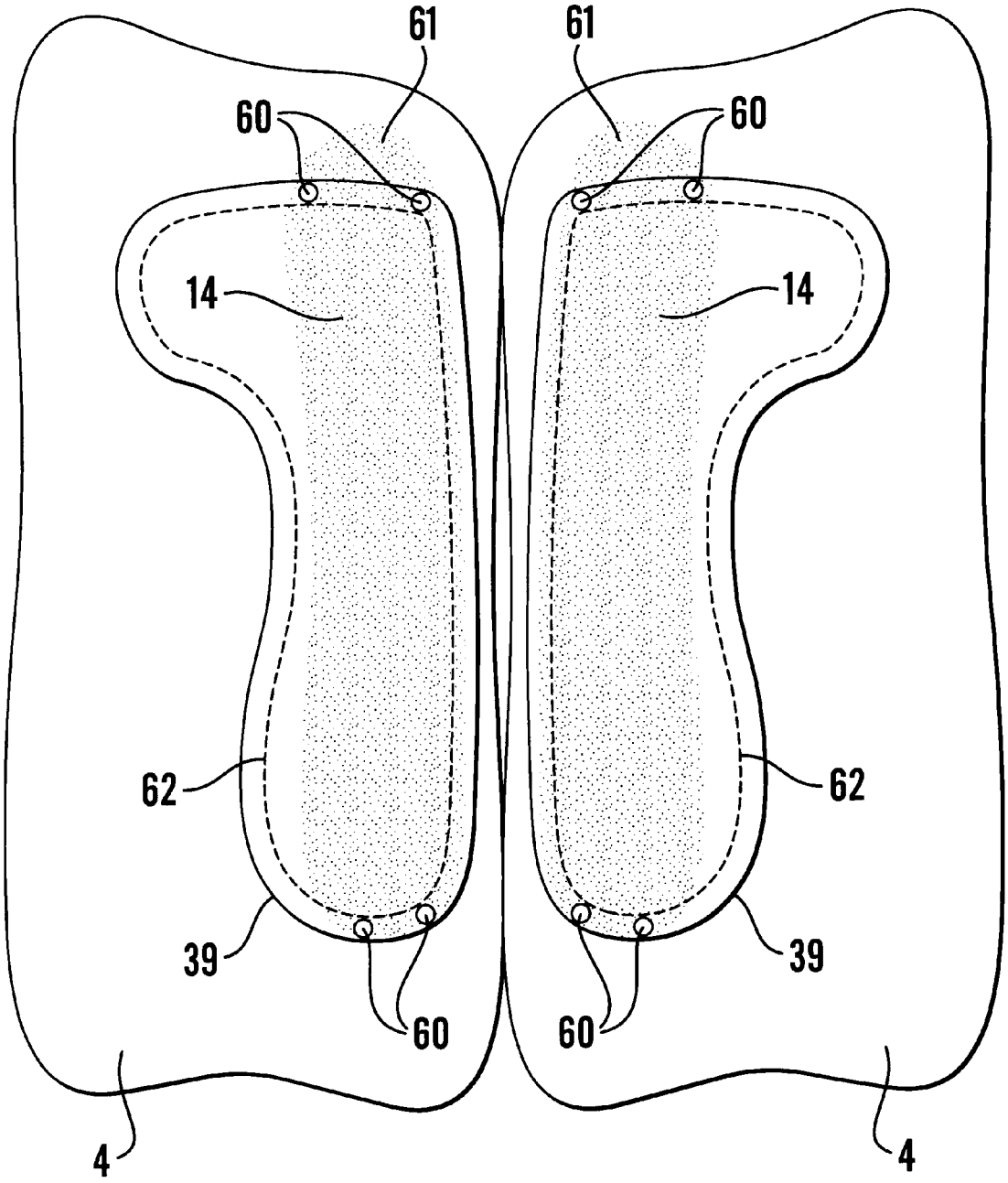
Figure 8:
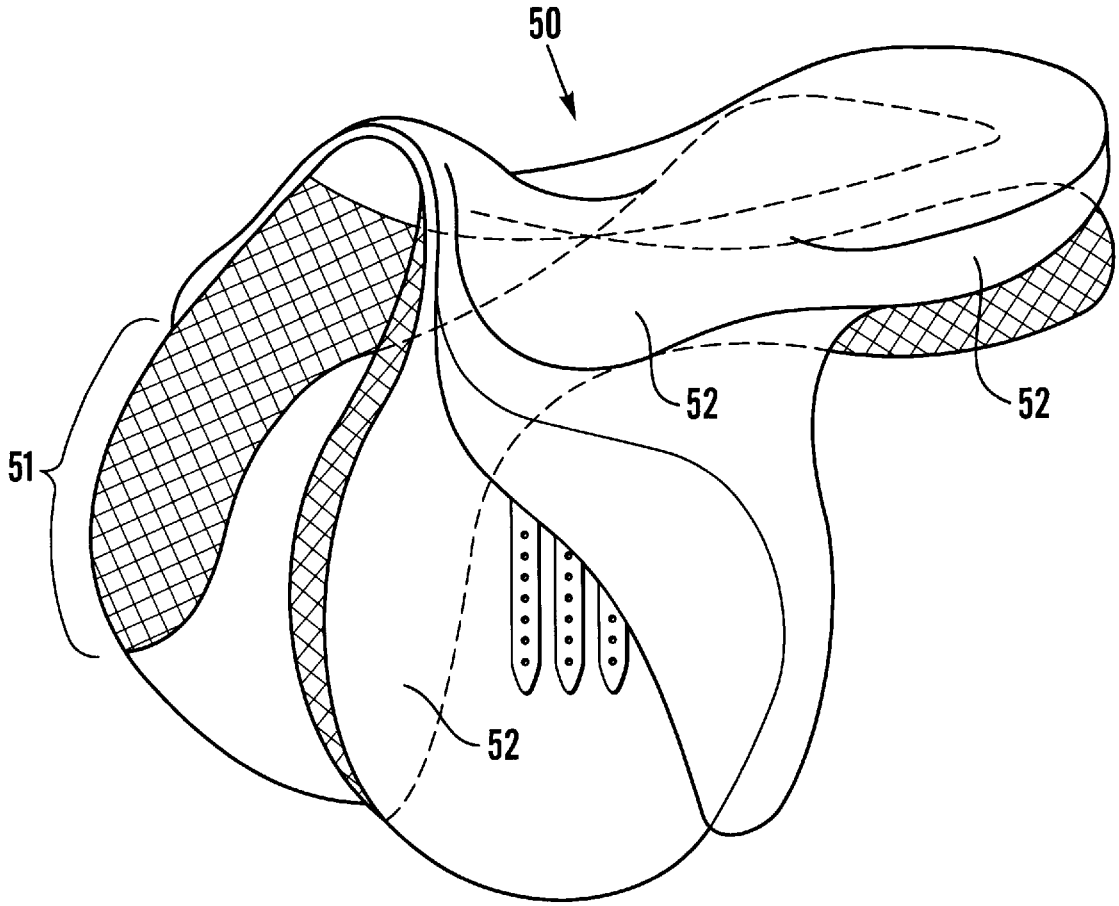
Figure 9:
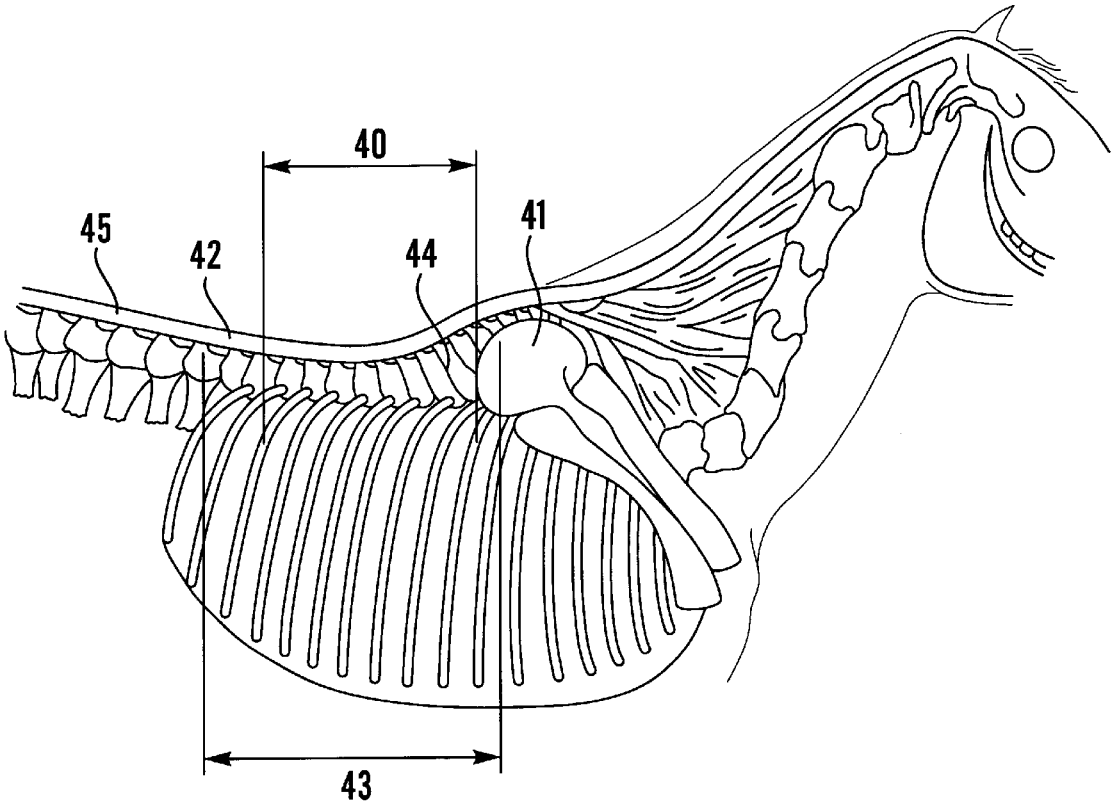

FIG. 3 section through horse and western saddle with saddlecloths;

FIG. 4 section through horse and western saddle with an embodiment of the present invention;

FIG. 5 sectional view of the embodiment of FIG. 4;

FIG. 6 plan view of the embodiment of FIG. 4;

FIG. 7 diagram of fixing and placement;

FIG. 8 illustrates a conventional European saddle in a side view;

FIG. 9 illustrates the horse's skeletal structure;

DETAILED DESCRIPTION

Figure 1:
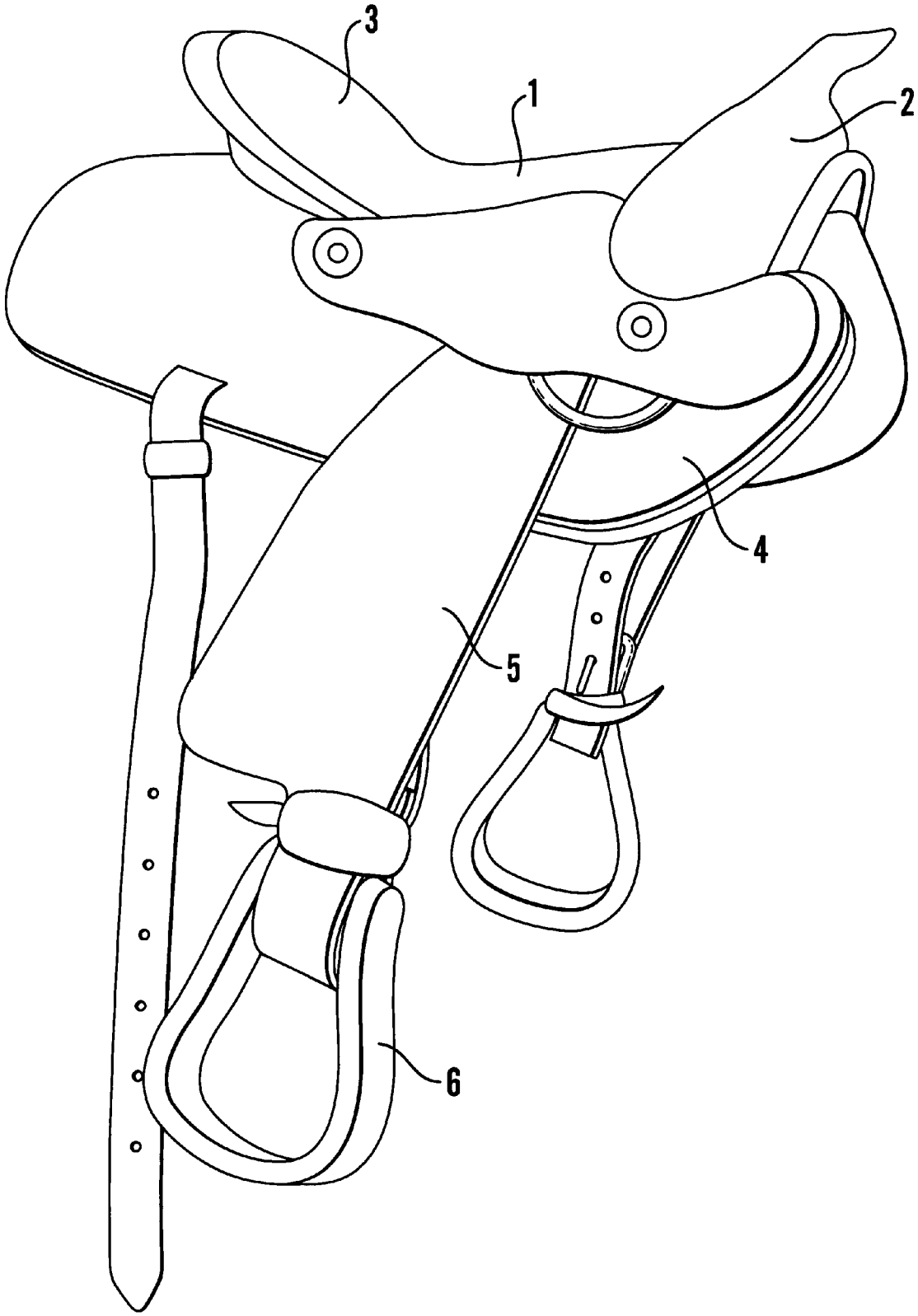
FIG. 1 illustrates a Western saddle in a side view.
Figure 2:
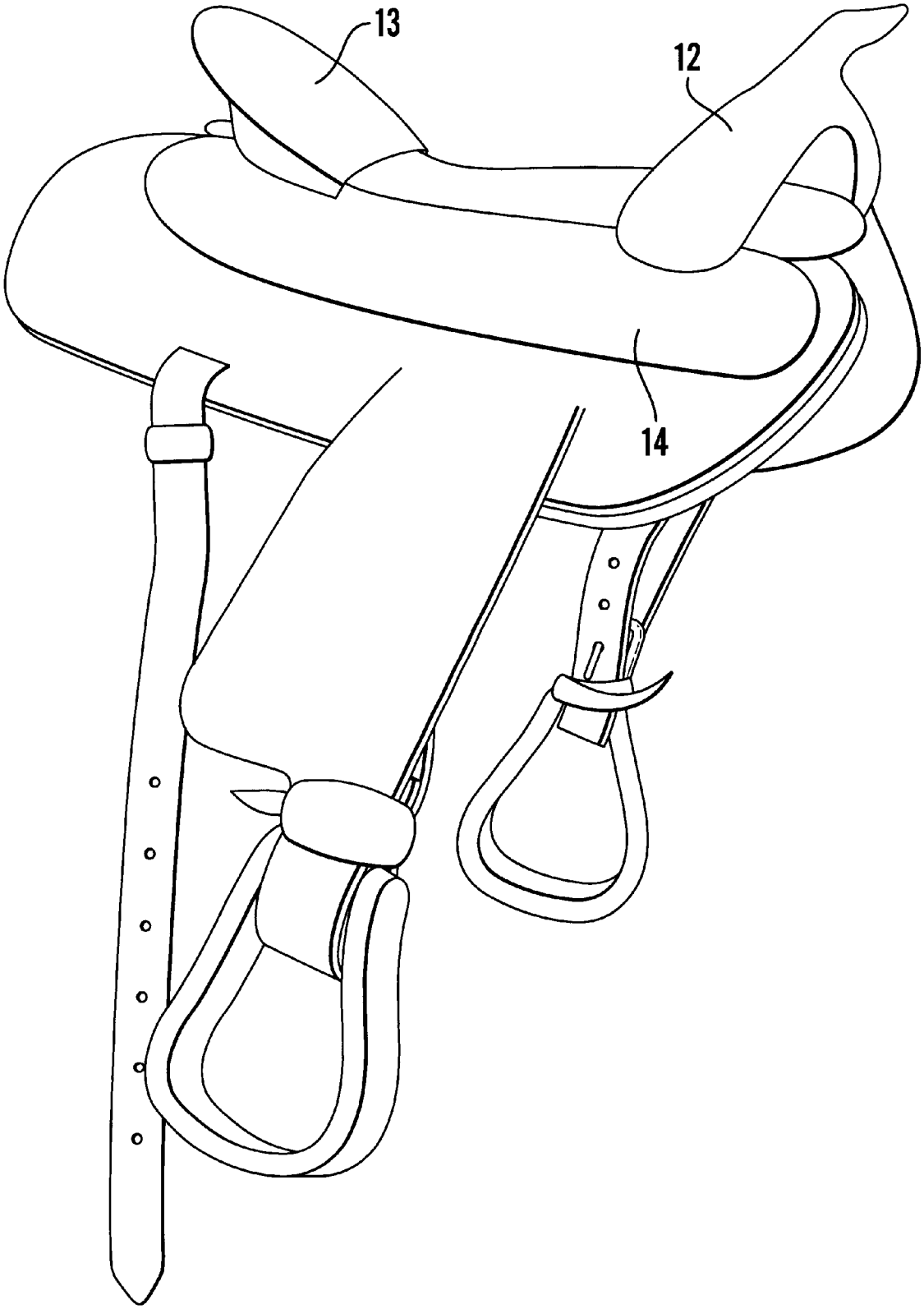
FIG. 2 illustrates the tree in a Western saddle in relation to the saddle structure.

To illustrate the present invention, it is convenient to outline the construction of a western saddle as is shown in FIGS. 1 to 2. The saddle secures the rider in place by means of a seat (1), which has a pommel (2) and a cantle (3) for support. The seat whilst made from leather, webbing and foam is formed on a solid structure called a tree. The tree can be broken down into three major pieces for description, the bars (14), of which there are two connected by two arches, the pommel arch (12) and the cantle arch (13). The bars (14) are covered from view by the skirts (4). These skirts (4) are made normally from two pieces of laminated material, the upper normally being a thick ornately decorated leather and the lower (the horse's side) being sheepskin or a synthetic equivalent.

Now with reference to FIGS. 3 –9 in most cases there is no additional padding between the horse (20) and both the bars (14) and the skirts (4). Therefore it is essential that the bars (14) and the skirts (4) be raised away from the horse's back (20) to allow some cushioning and alleviate pressure. To this end saddlecloths (21) are used and it is quite normal for them to be more than one and to be very thick. It should be noted at this point that in saddlery the muscular skeletal structure referred to as the wither are not the highest point of the shoulder but the part of the wither just behind the scapular (41). Because of the shape of the horse's back (20), especially at the wither (44) where the surface of the back can be at its most vertical, saddlecloths can cause major damage through pressure under the area (22) on the supraspinous ligament (42).

The area (40) which is covered by a European saddle (50) (FIG. 8) is much less than that area covered by a Western saddle (43) (FIG. 43). The forwardmost points of the bars (61) in a Western saddle extend further forward over the scapula (41) shown by area (43) than would be thought acceptable in European saddles (50) shown by area (40) (FIG. 9). This can cause direct pressure on the scapula (41) resulting in rubbing, soreness and bruising of the horse's back. Also direct pressure on this area may cause a shortening of the stride of the horse.

It is with this in mind that the present invention modifies the existing Western saddle so that it may:

1. Only apply pressure where the horse is capable of taking the pressures applied by the rider and the saddle (40);
2. Elevate the bars (14) and the skirts (4) of the western saddle away form the horses back to allow clearance for the scapula (41) and lumber (42) regions of the horse's back;
3. Allows a means of molding the underside of the saddle to the horse's back contour with the use of flocking (33) or an air system in its place as described in prior art European patent publication EP 0 764 607 A1, which can at present not be fitted in to Western saddles;
4. Allow the saddle to be accurately balanced for the rider's balance in the saddle and therefore the horse's comfort; as an unbalanced rider will not move as sympathetically with the horse as a balanced one;

5. Allow the Gullet (37) to be generous in width to alleviate pressure on the suprasinous ligament (45); and
6. Negate the need for a saddlecloth (21) or at least excessive saddlecloths (21) as is practiced currently.

This will benefit the horse by alleviating pressure and allowing a greater freedom of movement under saddle for the horse.

With reference to all figures, an embodiment of the present invention consists of two pockets which shall make up the conversion panel (39) that shall be shaped like a European saddle's (50) panel (52) but excluding the knee roll (51) area and are left and right handed. The reason for excluding the knee roll area is that this area in European saddles (50) is for rider stability and not horse comfort, whereas rider stability in a Western saddle is determined by the seat (1). The conversion panels (39) will be manufactured in different sizes and materials to cope with the variety of different saddle sizes and fabrics that are used to make them but the overall construction of the present invention will remain the same.

It is intended that a pocket is created or defined by using two pieces of material (30 & 31) for purposes of explanation we will describe these as a padded material (30) and a flexationally resistive material (31) such as stiff leather. The padded material is ideally sheepskin but could equally be a foamed synthetic material. The sheepskin (30) will be larger than the stiff leather (31) so the sheepskin gathers and overlaps when stitched (36), this is to create a smooth merging with the existing skirt (4) when attached.

To allow easy closing of the conversion panel (39) pocket, the sheepskin (30) is cut with a flap, which is shaved to removed the fleece prior to being covered with a hook and loop fixing such as Velcro (34 & 35) on both sides. Flap side (34) is loop Velcro the other side (35) is hook Velcro. This flap Velcro (34) mates with more hook Velcro (32) on the top surface of the conversion panel. Because the opposing side of the flap (35) is hook Velcro, the same type of Velcro as on the top of the conversion panel (32) no area of adhesion is lost for Velcro (32) when the conversion panel's (39) flap is closed.

It is normal practice when flocking a panel with wool that the majority of the panel is flocked with the panel off the saddle laying the wool in the panel flat like sheets so it does not ball. Once fitted to the saddle adjustments to fit are then achieved by pushing flocking into the panel through flocking holes (38) above this layered flocking (33).

The conversion panel (39) is fixed in place to the saddle skirts (4) by a Velcro (32 & 35) fixing to another loop Velcro strip (62) on the saddles skirts (4). This loop Velcro is stuck in place with rubber contact adhesive after the saddler has shaved the fleece off under side of the skirt (4) to match the area of Velcro (32). Alternatively a self-adhesive can be provided.

For extra security and so the rider may not easily move the conversion panels (39) out of place once fitted by the saddler, they may be screwed (60) to the bars (14) of the saddle's tree. If the panels were to be moved this could unbalance the saddle and or the rider in the same way as saddlecloths (21) becoming loose. Also by screwing the panels in the right place it gives a permanent and exact reference for refitting if the saddler wishes to remove the conversion panels (39) to re-flock them with new wool later.

The present invention will give the saddler a means of adapting existing Western saddles to the European method of saddle fitting but additionally will also facilitate the use of bladders or air-filled pockets or balloons as described in European patent publication EP 0 764 607 A1 (which is incorporated herein by reference in its entirety). This particular invention has shown distinct advantages over traditional methods of flocking European saddle panels in that it will always conform to the horse's shape and never give pressure points on the horse's back. Also, it will give Western saddlers that are not well versed in the traditional method used in European saddle a simple and more reliable method of fitting a saddle. Indeed, use of such air-filled pockets constitutes the preferred embodiment of the present invention. Bladders or air pockets are used in addition to or as a replacement for conventional flocking materials such as wool. For the purposes of the present invention, typically the pocket of each panel contains two such bladders generally co-planar and arranged so as to overlap slightly.

The present invention shall elevate the Western saddle bars and therefore the skirts of the saddle off the horse's back and shoulder thus alleviating pressure and irritation on these structures, whilst only applying pressure to those structures of the horse's back capable of taking weight of saddle and rider. The present invention will allow the creation of a gullet like that in a European saddle so direct pressure on the spinal processes will also be alleviated. If then, the saddler chooses to use the air system set out above instead of traditional flocking the advantages of freedom of movement and pressure relief will be multiplied.

What is claimed is:

1. A method of modifying a western style saddle having first and second skirts, the method comprising securing a panel to an undersurface of each skirt; wherein each panel comprises a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium.

2. A method as claimed in claim 1 wherein the resilient medium in each panel comprises at least one inflatable bladder.

3. A method as claimed in claim 2 wherein the resilient medium in each panel comprises two generally coplanar inflatable bladders arranged to provide an overlap between the two bladders.

4. A method as claimed in claim 1 wherein the resilient medium in each panel comprises wool.

5. A method as claimed in claim 1 wherein the padded material is natural or synthetic sheepskin or a foamed synthetic material.

6. A method as claimed in claim 1 wherein the flexationally resistive material is stiff leather.

7. A western style saddle having first and second skirts, each skirt having affixed to an underside thereof a respective panel; wherein each panel comprises a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium.

8. A saddle as claimed in claim 7 wherein the resilient medium in each panel comprises at least one inflatable bladder.

9. A saddle as claimed in claim 8 wherein the resilient medium in each panel comprises two generally coplanar inflatable bladders arranged to provide an overlap between the two bladders.

10. A saddle as claimed in claim 7 wherein the resilient medium in each panel comprises wool.

11. A saddle as claimed in claim 7 wherein the padded material is natural or synthetic sheepskin or a foamed synthetic material.

12. A saddle as claimed in claim 7 wherein the flexationally resistive material is stiff leather.

13. A panel adapted for mounting to an underside of a skirt of a western style saddle, the panel comprising a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium.

14. A panel as claimed in claim 13 wherein the resilient medium comprises at least one inflatable bladder.

15. A panel as claimed in claim 14 wherein the resilient medium comprises two generally coplanar inflatable bladders arranged to provide an overlap between the two bladders.

16. A panel as claimed in claim 13 wherein the resilient medium in each panel comprises wool.

17. A panel as claimed in claim 13 wherein the padded material is natural or synthetic sheepskin or a foamed synthetic material.

18. A panel as in claim 13 wherein the flexationally resistive material is stiff leather.

* * * * *